United States Patent [19]

Morgan

[11] 4,275,975

[45] Jun. 30, 1981

[54] MINE ROOF ANCHOR SYSTEM

[76] Inventor: Bennie E. Morgan, 411 E. Main St., Morganfield, Ky. 42437

[21] Appl. No.: 77,534

[22] Filed: Sep. 21, 1979

[51] Int. Cl.[3] ..... E21D 21/00

[52] U.S. Cl. ..... 405/261; 411/15; 411/44

[58] Field of Search ..... 405/259, 260, 261; 85/63, 79, 82

[56] References Cited

U.S. PATENT DOCUMENTS

| | | | |
|---|---|---|---|
| 2,697,914 | 12/1954 | Joy | 405/259 X |
| 3,139,730 | 7/1964 | Williams et al. | 405/259 |
| 3,837,258 | 9/1974 | Williams | 405/260 X |

*Primary Examiner*—David H. Corbin
*Attorney, Agent, or Firm*—Harvey B. Jacobson

[57] ABSTRACT

An elongated shaft assembly is provided including first and second end portions and the first end portion includes a non-circular end for rupturing and mixing, upon rotation of the first end portion, a resin capsule seated in a bore into which the first end portion is inserted. The second end portion of the shaft assembly includes a diametrically reduced externally threaded terminal end and a conical shoulder merges the threaded terminal end with the larger diameter section of the second end portion. Radially expandable and circumferentially rupturable sleeve structure is slidingly disposed on the diametrically reduced end portion for advancement toward and engagement with the conical shoulder for expanding and circumferentially rupturing the sleeve structure and an apertured roof plate is slidable on the diametrically reduced terminal end, thrust structure being threaded on the diametrically reduced terminal end and engageable with the sleeve structure for applying axial thrust thereto. The thrust structure includes a portion thereof abuttingly engageable with the side of the plate remote from the first end portion of the shaft assembly.

5 Claims, 4 Drawing Figures

Fig. 1
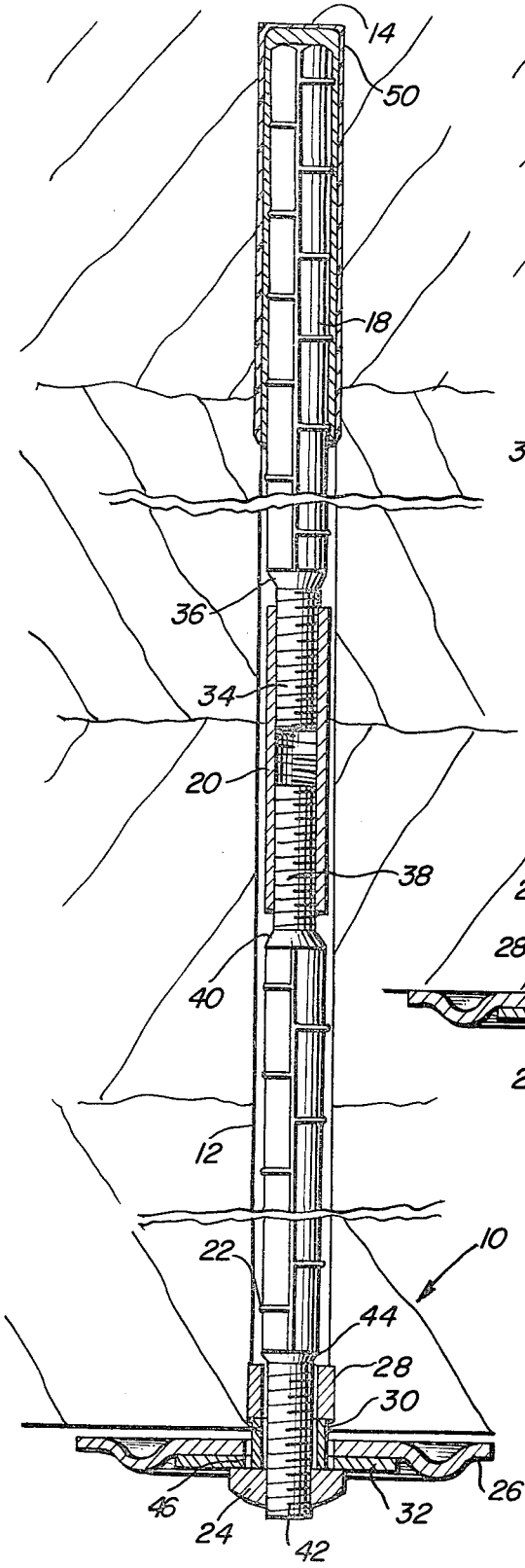
Fig. 2
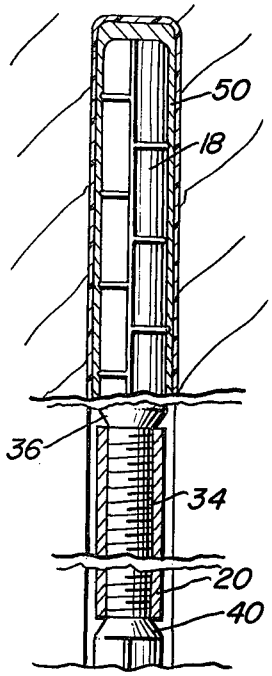
Fig. 3
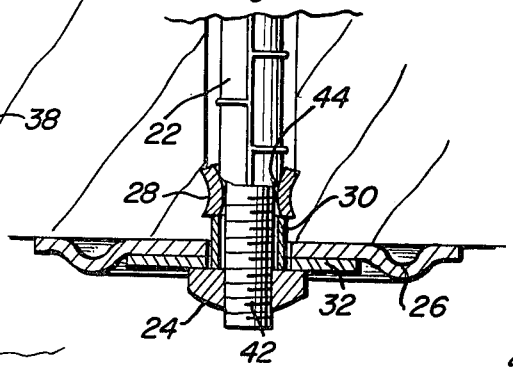
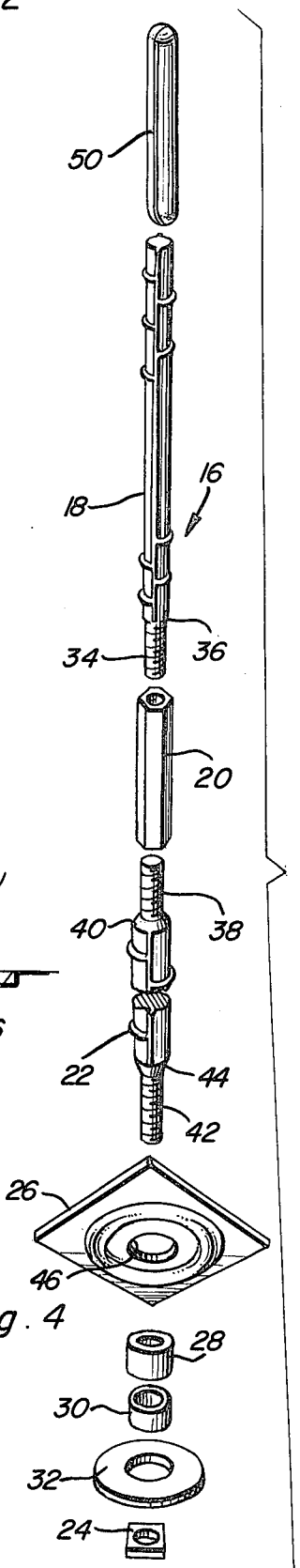
Fig. 4

MINE ROOF ANCHOR SYSTEM

BACKGROUND OF THE INVENTION

Various forms of mine roof anchors and rock bolts have been heretofore provided for anchoring in mine roofs and other rock formations. However, most earlier mine roof anchors and rock bolts utilized expandable anchors while more recent development in rock bolts and mine roof anchors has turned toward using grout (in different forms) to anchor a mine roof anchor or rock bolt to the associated rock or other ground formation.

These later forms of anchors and bolts are operative in a superior manner at relatively low cost, but in many instances the anchor or bolt may not be readily subject to proper tensioning after a grouting operation has been completed.

Examples of various forms of anchors and rock bolts including some of the general structural and operational features of the instant invention are disclosed in U.S. Pat. Nos. 3,336,758, 3,379,016, 3,695,045 and 3,893,303.

BRIEF DESCRIPTION OF THE INVENTION

The mine roof anchor of the instant invention comprises an elongated shaft assembly including a first end portion of non-circular configuration and which may be inserted into a rock bore for rupturing a resin capsule. After the resin capsule has been ruptured, the shaft assembly may be rotated whereby the non-circular first end portion thereof will effectively properly mix the resin and catalyst. After the resin and catalyst has been thoroughly mixed, the shaft assembly is held stationary in order to allow the resin to solidify. The holding time for the resin to begin solidification may be as short as five seconds and, thereafter, the resin grout will be fully cured within approximately five to ten minutes. The second end portion of the shaft assembly is diametrically reduced and externally threaded and a conical shoulder is defined between the diametrically reduced threaded end portion and the adjacent larger diameter portion of the second end of the shaft assembly. A radially expandable and circumferentially rupturable sleeve is loosely slidably disposed on the externally threaded terminal end and an apertured roof plate is slidable on the terminal end outside the sleeve. A thrust member is threadedly engaged on the terminal end behind the roof plate and includes a portion thereof projecting through the aperture in the roof plate and engageable with the sleeve. After the grout has fully hardened, the thrust member or structure may be threaded onto the bolt and will force the sleeve up onto the conical shoulder to be radially expanded and circumferentially fractured at substantially the same time the thrust structure engages the roof plate, whereby the roof plate will be tightly clamped to the roof and the shaft structure will be placed under longitudinal tension.

The main object of this invention is to provide a roof anchor system which will be capable of rapid installation and yet which will be inexpensive and enable a minimum number of workmen to install a large number of roof anchors in a reasonably short period of time.

Another object of this invention is to provide a roof anchor system including structure whereby roof anchors installed through utilization of the roof anchor system will be substantially foolproof.

A further important object of this invention is to provide a mine roof anchor system which will be capable of supporting greater than average loads.

A final object of this invention to be specifically enumerated herein is to provide a mine roof anchor system in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a schematic view illustrating the mine roof anchor system in position with the shaft assembly thereof inserted into a mine roof bore and the first inserted end of the shaft assembly in position immediately after having ruptured a resin capsule seated in the bore preparatory to rotation of the shaft assembly for thoroughly mixing the catalyst and resin of the capsule;

FIG. 2 is a schematic view of the upper portion of the assembly illustrated in FIG. 1 with the coupler fully threaded onto the anchor unit and the extension fully threaded into the coupler;

FIG. 3 is a schematic view of the lower portion of FIG. 1 illustrating the manner in which the threaded abutment structure and roof plate on the lower end of the roof anchor are utilized to radially expand and circumferentially fracture an anchor sleeve or bushing and clamp against the associated mine roof; and FIG. 4 is an exploded perspective view of the mine roof anchor.

DETAILED DESCRIPTION OF THE INVENTION

Referring now more specifically to the drawings, the numeral 10 generally designates a mine roof having a bore 12 drilled therein. The bore 12 includes a blind upper end 14 and the lower end of the bore 12 opens downwardly through the mine roof 10.

The mine roof anchor of the instant invention is referred to in general by the reference numeral 16 and includes an elongated anchor unit 18, a coupler 20, an extension rod 22 and a threaded thrust member 24. In addition, the anchor 16 includes a centrally apertured roof plate 26, a radially expandable and circumferentially rupturable bushing 28, a thrust sleeve 30 and a large abutment washer 32.

The anchor unit 18 and extension rod 22 comprise first and second end portions of an elongated shaft assembly also including the coupler 20. The first end portion for anchor unit 18 is circular in cross section and includes a diametrically reduced threaded end 34 as well as a conical shoulder 36 joining the diametrically reduced threaded end 34 to the circular portion thereof. The coupler comprises an internally threaded sleeve and the upper end of the extension rod 22 includes a diametrically reduced externally threaded end 38 joined to the lower portion of the extension rod 22 by another conical shoulder 40. The lower end of the extension rod 22 is diametrically reduced and threaded as at 42 and yet another conical shoulder 44 joins the lower externally threaded end portion 42 with the central portion of the extension rod 22 between the diametrically reduced ends 38 and 42 thereof. The threaded end 38 is threaded into the coupler 20 and joined by the latter to the lower end of the anchor unit 18. From FIG. 1 of the drawings it will be seen that the over-all length of the coupler 20 is greater than the combined length of the end portions 34 and 38.

The roof plate 26 is provided with a large diameter central aperture 46 and is disposed on the lower diametrically reduced threaded end 42 of the extension rod 22 outside the bushing 28 which is disposed on the end 42 between the plate 26 and the shoulder 44. The thrust sleeve 30 is disposed on the end portion 42 behind the bushing 28 and is receivable through the aperture 46 in the roof plate 26. The washer 32 is disposed on the end 42 behind or below the roof plate 26 and the thrust member or nut 24 is threaded on the end 42 below the washer 32.

In operation, the bore 12 is formed in the mine roof 10 to a given depth and the coupler 20 is assembled to the anchor unit 18. Then, the extension rod 22, of a predetermined length according to the depth of the bore 12, is joined to the coupler 20 in the manner illustrated in FIG. 1 of the drawings, and the bushing 28, sleeve 30, roof plate 26, washer 32 and thrust member or nut 24 are mounted on the lower end 42 of the extension rod 22 in the manner illustrated in FIG. 1. Thereafter, a resin capsule 50, such as a CARBOLOY resin capsule, is inserted into the bore and the assembled mine roof anchor 16 is inserted into the bore 12 behind the capsule 50.

After the capsule has seated in the upper end 14 of the bore 12 the mine roof anchor 16 is forced further into the bore 12 to the position thereof illustrated in FIG. 1 rupturing the capsule 50 and with the plate 26 spaced slightly from the mine roof face in order to rupture the capsule 50. Then, the shaft assembly is rotated by rapidly turning the thrust member 24, the latter abutted against the thrust sleeve 30 and the thrust sleeve 30 being abutted against the bushing 18 which is in turn engaged with the shoulder 44. Depending upon the speed of rotation of the thrust member 24, the latter is rotated for approximately 5 to 45 seconds in order that the catalyst and resin within the capsule 50 will be thoroughly mixed. Thereafter, the mine roof anchor is held stationary for approximately 15 seconds to allow the resin to solidify.

After a period of approximately 5 to 15 seconds, the resin will be substantially fully hardened and the thrust member 24 is again turned whereupon inasmuch as all of the described threads are right-hand threads the coupler 20 will be threaded further onto the anchor unit 18 into tight engagement with the shoulder 36, the extension rod 22 will be further threaded into the coupler 20 to bring the shoulder 40 into tight engagement with the lower end of the coupler 20 and the thrust sleeve 30 will force the bushing 28 up onto the conical shoulder 44 resulting in the bushing 28 being radially expanded and thereafter circumferentially ruptured to tightly wedge the bottom of the extension rod 22 within the bore 12. Of course, by the time the bushing 28 has been radially expanded and circumferentially ruptured, the thrust member 24 and washer 32 have forced the roof plate 26 into engagement with the face of the mine roof 10. In this manner, the roof plate 26 is tightly abutted against the face of the mine roof and the entire length of the mine roof anchor 16 has been placed under proper axial tension.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A mine roof anchor system including an elongated upstanding shaft assembly having first upper and second lower end portions, said first upper end portion including means for rupturing and mixing, upon rotation of said first end portion thereagainst, a resin capsule seated in a bore into which said first end portion is inserted, the second lower end portion of said shaft assembly including a diametrically reduced externally threaded terminal end and a conical shoulder merging said threaded terminal end with the large diameter section of said second end portion, radially expandable sleeve means slidingly disposed on said diametrically reduced terminal end, a roof plate having a central aperture formed therethrough slidable on said diametrically reduced end below said sleeve means, thrust structure threaded on said diametrically reduced end below said plate and including an upper portion projecting and slidable through said aperture and engageable with said sleeve means for applying axial thrust thereto, said thrust structure including a lower portion thereof abuttingly engageable with the side of said plate remote from said sleeve means.

2. The combination of claim 1 wherein said first and second end portions comprise first and second end members including adjacent aligned ends removably secured together.

3. The combination of claim 2 wherein said adjacent ends comprise threaded diametrically reduced terminal end sections, an internally threaded sleeve into whose opposite ends said terminal end sections are similarly removably threaded.

4. The combination of claim 3 wherein the remote ends of said terminal end sections include opposing conical shoulders, the opposite ends of said sleeve being abuttingly engaged with said shoulders and wedged thereonto.

5. The combination of claim 1 wherein said thrust structure lower portion includes a nut threaded on said diametrically reduced terminal end, said thrust structure upper portion including a thrust sleeve slidable on said diametrically reduced terminal end above said nut between the latter and said rupturable sleeve means for axial engagement with the latter.

* * * * *